US005924787A

United States Patent [19]

McEllen et al.

[11] Patent Number: 5,924,787

[45] Date of Patent: Jul. 20, 1999

[54] METAL HALIDE LAMPS AND METHOD OF MANUFACTURE

[75] Inventors: John McEllen; Juris Sulcs, both of Chagrin Falls, Ohio

[73] Assignee: Advanced Lighting Technologies, Inc., Solon, Ohio

[21] Appl. No.: 08/645,115

[22] Filed: May 13, 1996

[51] Int. Cl.[6] ..... F21S 1/02

[52] U.S. Cl. ..... 362/263; 362/265; 362/414; 362/431; 362/127

[58] Field of Search ..... 362/229, 249, 362/251, 263, 264, 265, 410, 411, 414, 431, 373, 294

[56] References Cited

U.S. PATENT DOCUMENTS

| | | | |
|---|---|---|---|
| 2,144,931 | 1/1939 | Poey | 362/228 |
| 3,930,148 | 12/1975 | Gruen | 362/229 |
| 5,016,154 | 5/1991 | Leeyeh | 362/414 |

*Primary Examiner*—Thomas M. Sember
*Attorney, Agent, or Firm*—Rogers & Killeen

[57] ABSTRACT

Metal halide table and floor lamps and method of manufacture. A lamp base module housing a power supply, ballast, and illumination controls separate from a metal halide bulb with the metal halide bulb housed within the base or a luminaire module. Lamp modules of various size and appearance may be manufactured separately and easily assembled by those of but ordinary skill.

35 Claims, 4 Drawing Sheets

METAL HALIDE LAMPS AND METHOD OF MANUFACTURE

BACKGROUND OF THE INVENTION

This invention is directed generally to metal halide table and floor lamps and their manufacture. More particularly, this invention is directed to metal halide table and floors lamps which advantageously separate an easily replaceable, metal halide bulb from its associated power supply, ballast, and control circuits while presenting a conventional lamp appearance. The invention is further directed to a method of manufacture of such lamps which provides for assembly by those of but ordinary skill.

The advantages of metal halide lighting include excellent lighting characteristics, exceptional long bulb life, and low cost per lumen of light output. These advantages are well known and have been exploited in various outdoor and industrial indoor applications, e.g., exterior street lighting, racket ball and other interior sports area lighting, and interior warehouse area lighting.

Previously, metal halide lighting for conventional interior portable residential table and floor lamps, has not been practical due to limitations associated with metal halide bulbs, e.g., size, volume, and power requirements of bulb power supply and ballasts as well as safety concerns with metal halide bulb explosions.

Prior art efforts to overcome these problems have not been completely successful. For example, previous metal halide bulbs for use in interior lamps have suffered being unsightly, expensive, being less efficient, from slow startup times and hot restart problems. General Electric has produced the Halarc (tm) and Miser (tm) Maxi-Light (tm) which feature conventional edison base bulbs for use with existing socketed lamps. However, these bulbs include, as part of the lower portion of the bulb base, an unsightly electronic control capsule which includes the power supply, ballast and controls required by the metal halide bulb. The control capsule give the bulb an unsightly bulging appearance which is unacceptable when viewed within a lamp. Additionally, the control capsule increases the cost of the bulb and provides a lumen efficient of less than three, i.e., 150 watts of "incandescent" light for 55 watts of power.

An important advance in the art is made and many of the problems of the prior art are obviated by the current invention.

Accordingly, it is an object of the present invention to provide a novel metal halide lamp and method of manufacture suitable for use as a table or floor lamp.

It is another object of the present invention to provide a novel modularized metal halide table or floor lamp and method of manufacture enabling those of but ordinary skill to assemble the final lamp.

It is yet another object of the present invention to provide a novel lamp including a base housing electronic components separate from a metal halide bulb permitting maintenance of the electronic components and easy, economical replacement of the metal halide bulb.

It is a further object of the present invention to provide a novel lamp advantageously utilizing both metal halide and incandescent bulbs which may be operated individually or in combination.

It is yet a further object of the present invention to provide a novel metal halide lamp modular manufacturing method permitting final lamp assembly by those of but ordinary skill.

It is still another object of the present invention to provide a novel lamp including a base housing electronic components and a separate metal halide bulb positioned proximate an aperture for transferring light from the base to a light transport means.

It is still a further object of the present invention to provide a novel metal halide lamp having a liquid crystal light control aperture.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Figure 1:
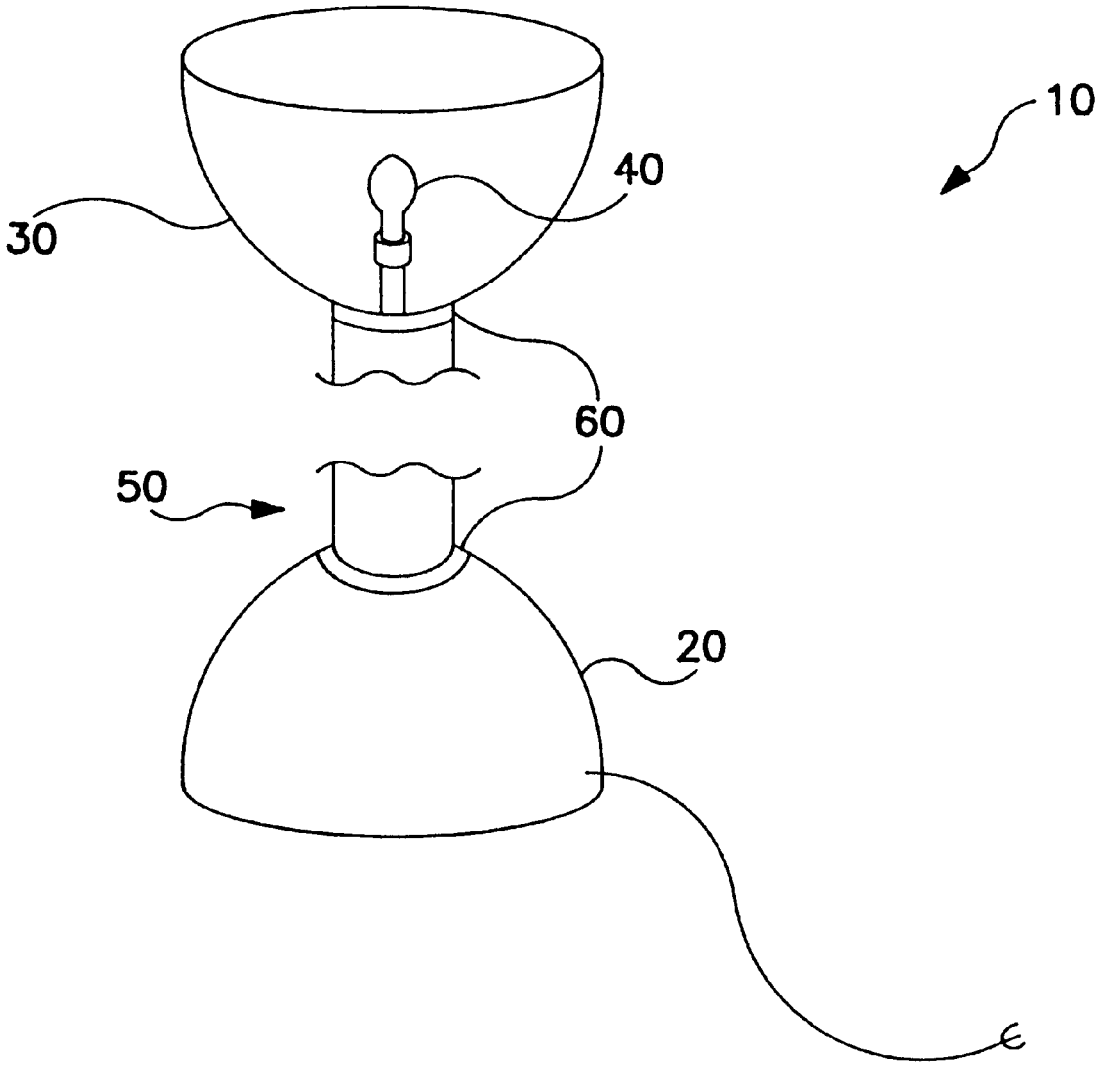
FIG. 1 is a pictorial representation of one embodiment of the present invention.

With reference to FIG. 1, the present invention is illustrated by a preferred embodiment suitable as either a floor or table lamp. Lamp 10, illustrated in FIG. 1, includes three interconnecting modules: base 20, luminaire 30 enclosing metal halide bulb 40, and joining member 50. Base 20 includes an internal cavity which provides a mounting area for the electronic components required by the metal halide bulb 40. Advantageously, the invention overcomes problems of the prior art by permitting maintenance of the electronic components and facilitating use of an attractive, economical, and easy to replace metal halide bulb.

Lamp 10 may further optionally include couplings 60 and quick-connect wiring connectors (not shown) which permit easy lamp assembly by those of but ordinary skill by coupling luminaire 30 and base 20 to joining member 50. The quick-connect wiring connectors are conventional and may, for example, include: snap together connectors; twist together connectors; coded twist together wiring with separate protective caps; and plug and socket complimentary connectors. Joining member 50 may be of any desirable length, e.g., of several feet for a floor lamp or of several inches for a table lamp. Alternatively, the joining member may be omitted by including mating couplings 60 on base 20 and luminaire 30. Manufacturing base 20, luminaire 30, and joining member 50 with complimentary sized couplings 60, permits manufacturing each modules in a wide variety of sizes and appearances while retaining easy assembly. The invention's method of manufacturing and assembly thus overcomes prior art problems of manufacturing metal halide lamps meeting the aesthetic and functional requirements of various manufacturers while permitting assembly by those of but ordinary skill.

Figure 2:
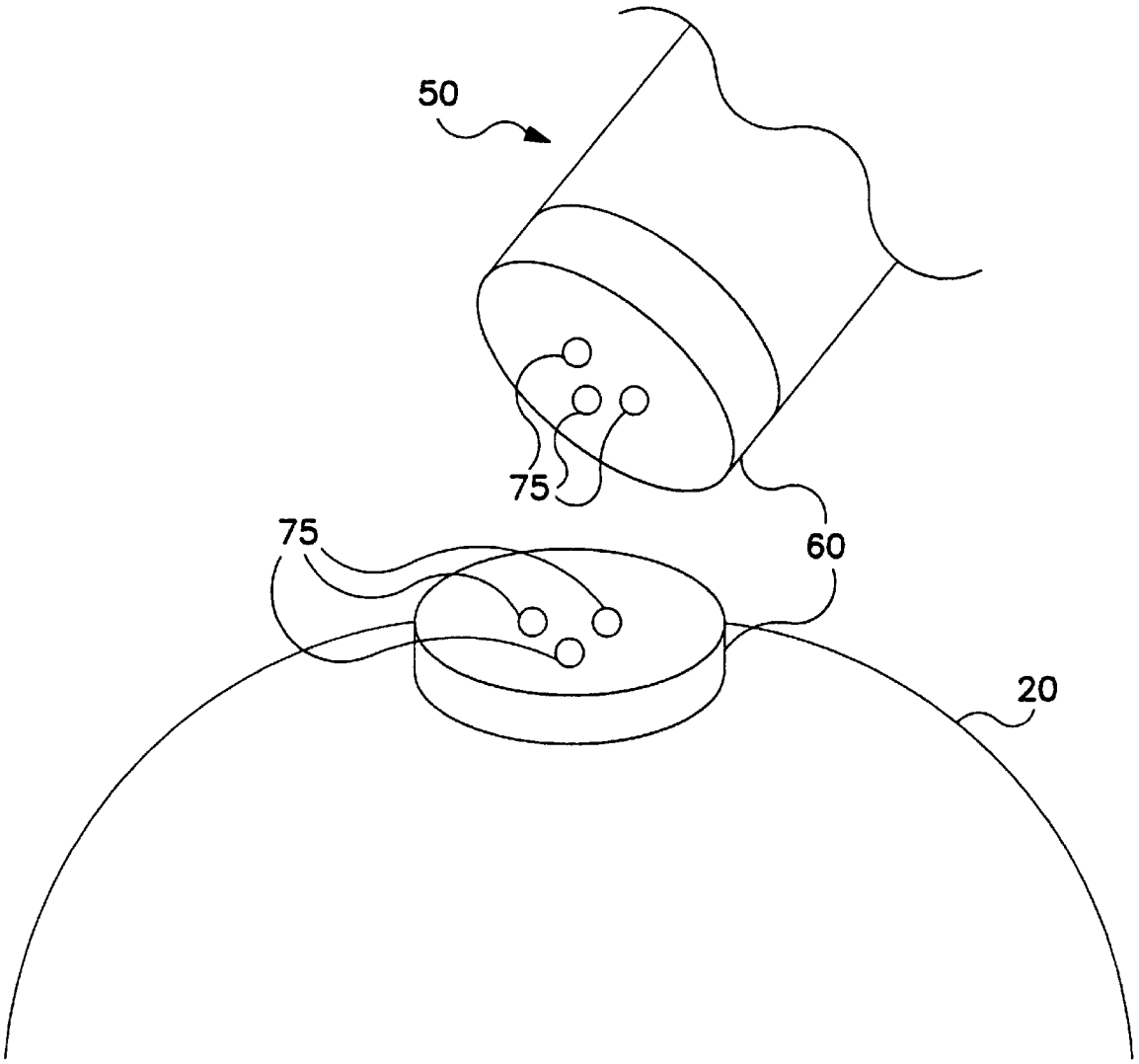
FIG. 2 is an illustration of couplings including integrated wiring contacts.

In an optional embodiment, FIG. 2, the couplings 60 may integrated wiring contacts 75 obviating the requirement for quick-connect wiring connectors. The couplings 60 are conventional and may, for example, be: twist and lock; screw together; snap together and slip together.

Figure 3:
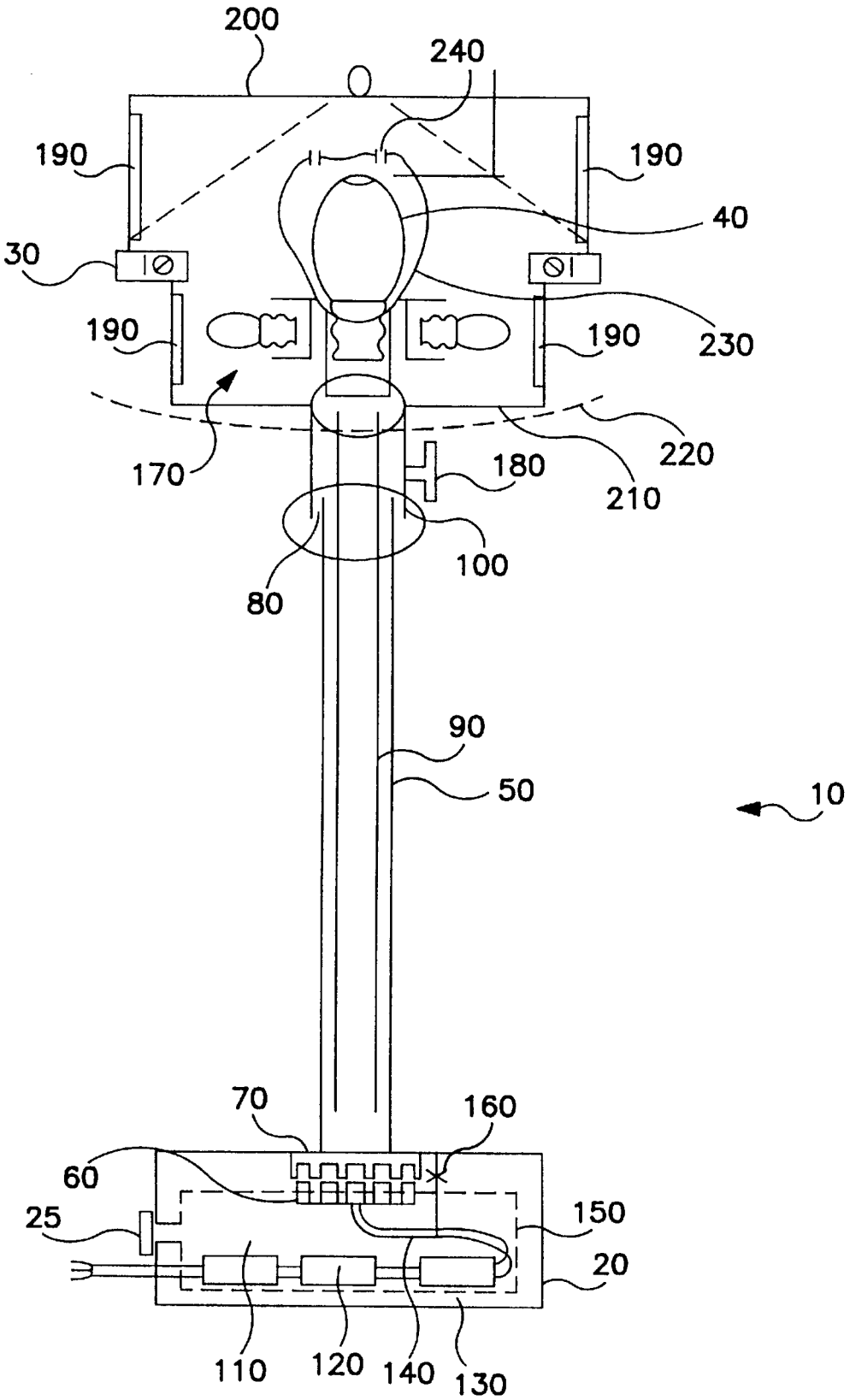
FIG. 3 is a pictorial representation of another embodiment of the present invention.

FIG. 3 illustrates another preferred embodiment of the present invention also suitable as either a modularized floor or table metal halide lamp. Lamp 10 of FIG. 3 includes three interconnecting modules: base 20, luminaire 30 enclosing metal halide bulb 40, and joining member 50.

Base 20 includes base coupling 60. Luminaire 30 includes luminaire coupling 100. Joining member 50 terminates with lower coupling 70, mated to base coupling 60, and upper coupling 80, mated to luminaire coupling 100. Joining member 50 further includes an internal passage containing a high-voltage wiring harness 90. In the embodiment illustrated by FIG. 3, wiring harness 90 terminates as part of lower coupling 70 and upper coupling 80 such that lower coupling 70 and upper coupling 80 serve the dual functions of electrical connections and mechanical connections between base 20, joining member 50, and luminaire 30. Optionally, the various couplings may be provided with internal openings and wiring harness 90 may utilize conventional terminations. This optional arrangement thereby allowing wiring harness 90 to pass through lower coupling 70 and base coupling 60 to connect with associated wiring in base 20. Similarly, wiring harness 90 can pass through upper coupling 80 and luminaire coupling 100 to connect with associated wiring in luminaire 30.

As shown in FIG. 3, base 20 incorporates a cavity within which power supply 110, ballast 120, and illumination controls 130 are mounted and via wiring 140 connected to base coupling 60. Lamp switch 160 is mounted on the exterior of base 20 and electrically connected to illumination controls 130. An access plate (25) provides an opening into the cavity of base 20 in order to perform maintenance on the components within the cavity. Optionally, power supply 110, ballast 120, and illumination controls 130 may be constructed as a single box assembly 150 having base coupling 60 incorporated therein. Further, the access plate may optionally include a safety interface to assure that there is no live voltage within the base after the access plate is removed.

These features of the present invention overcome prior art problems of power supply and ballast size, volume, and safety problems.

Power supply 110 receives power from household 110 volt AC power receptacle. Alternatively, power supply 110 could receive power from a 220 volt AC power receptacle. Ballast 120 is of a pulse-start, solid-state type thereby more rapidly starting the metal halide bulb, improving full-illumination startup time and improving lumen efficiency to four to five, e.q., 300 watts of "incandescent" light for 70 watts. The prior art metal halide bulbs took approximately 60 seconds to come to a full illumination level. This invention advantageously reduces that startup time to 40 seconds and preferably 30 seconds. In some preferred embodiments the startup time is reduced to 20 seconds.

Wiring harness 90 is desirably pulse rated for 600 volts.

Luminaire 30 further includes incandescent bulb 170. Illumination controls 130 allows the operation of metal halide bulb 40 and incandescent bulb 170 individually or in combination. Incandescent bulb 170 is also controlled by dimmer 180. Optionally, incandescent bulb 170 may be included as part of the ballast circuit to further enhance startup illumination during hot startup conditions.

To diffuse the light exiting the bottom of luminaire 30, diffuser 220 is installed. With further reference to FIG. 3, the luminaire 30 incorporates liquid crystal areas 190 under control of illumination controls 130. By varying the opacity of liquid crystal areas 190, the light exiting luminaire 30 is controlled. The present invention also envisions alternative means of controlling the opacity of liquid crystal areas 190 such as with dimmer switches or touch-pads.

The luminaire 30 FIG. 3 consists of upper section 200 and lower section 210 serving as the lamp shade or globe. In this embodiment these of rigid glass construction offering protection from the possible explosion of metal halide bulb 40. In other alternative embodiments, luminaire 30 may consist of mixed glass and fabric sections or all fabric sections. Additionally, luminaire 30 may utilize a single piece shade or globe.

In some embodiments of the invention desirably utilize protective metal halide bulb shield 230 which may further optionally include air ports 240. Shield 230 is manufactured of glass suitable to withstand the heat given off by metal halide bulb 40.

Figure 4:
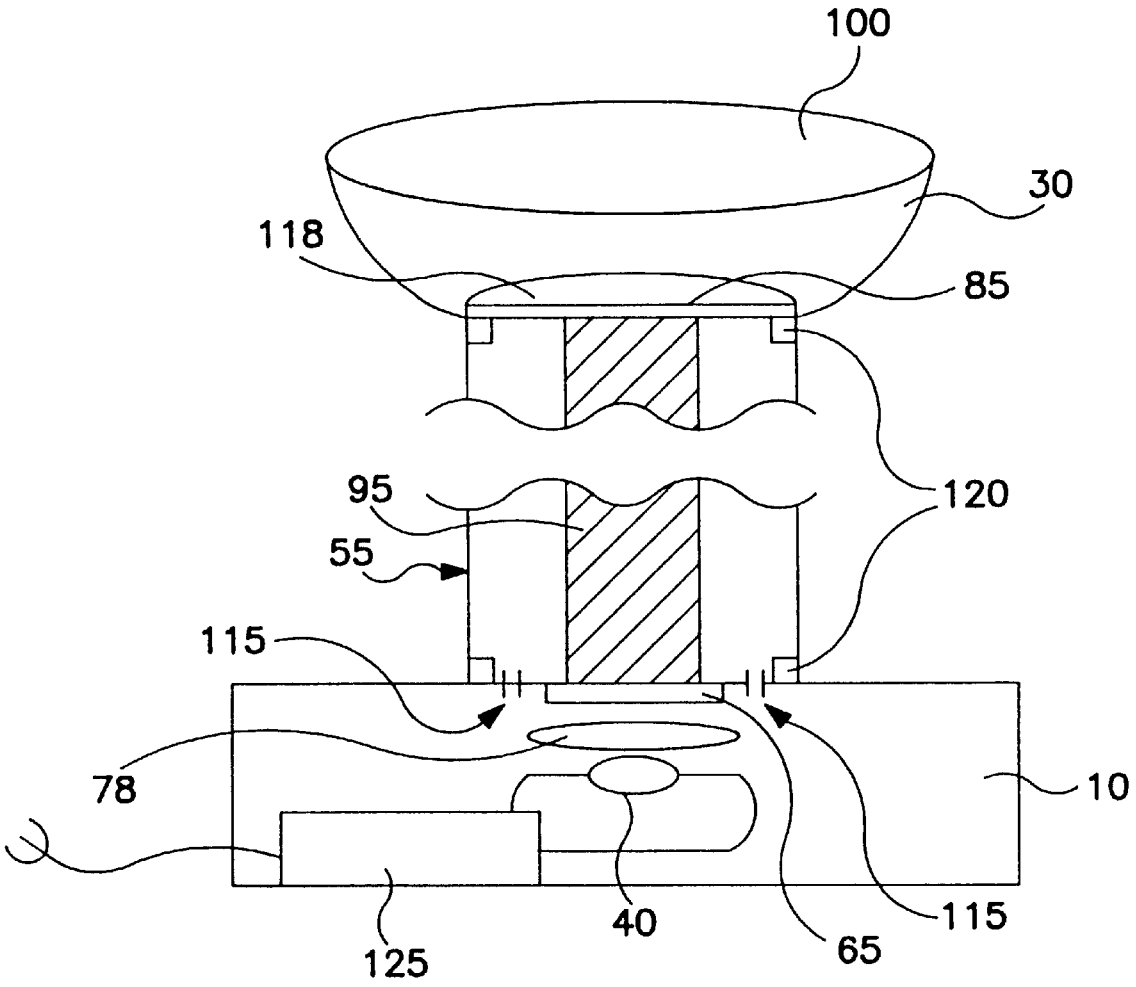
FIG. 4 is a pictorial representation of another embodiment of the present invention.

FIG. 4 is a pictorial representation of another preferred embodiment of the present invention. The lamp of this embodiment consists of three modules: base 10, light transport 55, and luminaire 30.

Base 10 serves as an enclosure for both metal halide bulb 40 and electronics 50 for powering and operating bulb 40. Base 10 further includes an aperture 65 permitting the light from bulb 40 to exit the base 10. As shown in FIG. 4, bulb 40 is positioned proximate aperture 65. Optionally, lens 78, positioned intermediate bulb 40 and aperture 65 enhances the light transmission from bulb 40 through aperture 65.

Air ports 115 provide a means of dissipating heat from base 10. Placing air ports 115 within an area enclosed by light transport 20 assures efficient heat convection away from the base without concern of air ports 115 becoming clogged from dust or other particles coming in contact with the remaining external surfaces of base 10. In alternative embodiments of the present invention, the base 10 may not be fully enclosed, thereby obviating the need for air ports 115.

To provide for easy replacement of electronics 50 and metal halide bulb 40, base 10 includes as access plate (25). While in the embodiment of the present invention illustrated by FIG. 4, the lamp electronics 125 comprise a single assembly box, other optional embodiments of the invention mount a power supply, ballast, and illumination controls within base 10. In still other embodiments, the power supply and ballast are outside base 10, e.g., integral with the lamp power cord or integral with the power plug. In these embodiments, the illumination controls may also be outside base 10, e.g., integral with the lamp power cord or within a remote wireless control.

Light transport 20 connects base 10 at aperture 60 to luminaire 30 at aperture 85. Light transport 55 functions to transport light from aperture 60 to aperture 85. In the preferred embodiment illustrated by FIG. 4, light transport 55 includes an internal passage containing light pipe 95 which meets aperture 60 and aperture 85 to achieve the light transport function. The light pipe is conventional, for example, may be of glass, plastic, and plastic film. In alternative embodiments of the invention light pipe 95 is not used and light transport 55 transports the light from base 10 to luminaire 30.

Luminaire 30, as shown in FIG. 4, having received the light from transport 20, disperses light through lens 110 and frosted diffuser 100. In other optional embodiments of the present invention, lens 118 and lens 78 may be replaced by, or supplemented with, liquid crystal gates. Varying the opacity of the liquid crystal gates controls the transfer of light exiting base 10 and entering luminaire 30 respectively. Still other embodiments provide selectably controllable liquid crystal areas on the exterior surface of luminaire 30 for the purpose of controlling the light exiting luminaire 30.

While the lamp illustrated by FIG. 4 diffuses light through diffuser 100, an alternative embodiment includes a light reflector with luminaire 30. Optionally, liquid crystal regions with selectable degrees of reflectance may be mounted on the light reflector in order to selectively control the amount of light reflected off the reflector and thereafter exiting luminaire 30.

Further optional embodiments of the present invention as illustrated in FIG. 4 may provide a bulb socket and wiring for an incandescent bulb within luminaire 30.

While not essential, an alternative embodiment of the invention similar to that illustrated by FIG. 4 also includes couplings 120. Couplings 120 facilitate modular construction of base 10, light transport 55, and luminaire 30 with their later assembly into a lamp by those of but ordinary skill.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A portable combination metal halide and incandescent bulb lamp suitable for interior living space area illumination comprising:

(a) a base for supporting the lamp and containing electronics necessary to operate the lamp, said base including:
  (i) a housing defining an internal cavity, and
  (ii) an electronics assembly within said cavity, said assembly including a power supply, ballast and illumination controls for a metal halide bulb socket;

(b) a luminaire for providing color-balanced, low-cost light comprising:
  (i) a metal halide bulb socket adapted to removably receive a metal halide bulb,
  (ii) a plurality of incandescent bulb sockets each adapted to removably receive an incandescent bulb, and
  (iii) an enclosure laterally surrounding said sockets, said enclosure providing (i) a lateral shield from a bulb shattering while received in said metal halide bulb socket and (ii) the diffusion of light from bulbs in said sockets;

(c) an elongated decorative luminaire support means having an internal passage longitudinally thereof;

(d) coupling means:
  (i) for mechanically connecting said base to said support means and said support means to said luminaire,
  (ii) for electrically connecting the electronics assembly in said base to the metal halide socket in said luminaire, and
  (iii) for electrically connecting a cord and plug means to the incandescent sockets in said luminaire;

(e) cord and plug means for electrically connecting the power supply of said base to a suitable source of commercial residential electrical power;

(f) metal halide switch means for controlling the application of power to said metal halide socket; and (g) control means for controlling the application of current to said incandescent bulb sockets independently of the application of power to said metal halide socket through said switch means.

2. The lamp of claim 1, wherein at least one of said plurality of incandescent bulb sockets is operatively connected to the ballast in said base.

3. The lamp of claim 1, wherein said ballast is a solid state, pulse-start ballast.

4. The lamp of claim 1, wherein said coupling means includes a wiring harness carried internally of said elongated luminaire support means.

5. The lamp of claim 1, wherein said ballast and said wiring harness is pulse rated for approximately 600 volts.

6. The lamp of claim 1, wherein said metal halide bulb socket includes a fail-safe switch operative to remove power to said metal halide socket when a bulb is absent from said socket.

7. The lamp of claim 1, wherein said coupling means includes a quick-connect/disconnect means between said base and said luminaire support means and between said luminaire support means and said luminaire.

8. The lamp of claim 1, wherein said control means is operative to selectively provide (i) only metal halide bulb illumination, (ii) only incandescent bulb illumination, and (iii) both metal halide and incandescent bulb illumination.

9. The lamp of claim 1 wherein one or more of the incandescent bulb sockets is operatively connected to the ballast so that an incandescent bulb received therein provides resistance to the ballast.

10. A portable metal halide table lamp suitable for interior illumination comprising:

a base for supporting the lamp comprising an internal cavity, a power supply mounted within said cavity, a ballast mounted within said cavity operatively connected to said power supply, and a power cord operatively connected to said power supply and extending from said base for connection to a residential power receptacle;

a luminaire comprising a metal halide bulb socket for receiving a metal halide bulb and an enclosure surrounding said socket; and a joining member connecting said base to said luminarie, said joining member forming a longitudinal central axis of the lamp.

11. The lamp of claim 9, said base further comprising illumination controls operatively connected to said ballast.

12. The lamp of claim 11, wherein said ballast, power supply, and illumination controls are contained in a single, closed electronics assembly, said electronics assembly being mounted in said internal cavity.

13. The lamp of claim 9, wherein said ballast is a pulse-start, solid-state type and said ballast and said metal halide bulb socket are connected with a wiring harness pulse rated for approximately 600 volts.

14. The lamp of claim 10 wherein said joining member has a length of less than approximately four feet.

15. The lamp of claim 9 further comprising one or more incandescent bulb sockets operatively connected to the ballast so that an incandescent bulb received therein provides resistance to the ballast.

16. A portable metal halide table lamp suitable for interior illumination comprising:

a base for supporting the lamp comprising an internal cavity, a power supply mounted within said cavity, a ballast mounted within said cavity operatively connected to said power supply, and a power cord operatively connected to said power supply and extending from said base for connection to a residential power receptacle;

a luminaire comprising a metal halide bulb socket for receiving a metal halide bulb and an enclosure surrounding said socket; and a joining member connecting said base to said luminaire, wherein said base further comprises an access means for performing maintenance on said ballast and power supply, said access means connected to a safety interlock to de-energize all electrical components when said access means is removed.

17. A portable metal halide lamp suitable for interior illumination comprising:

a base for supporting the lamp comprising an internal cavity, a power supply mounted within said cavity, a ballast mounted within said cavity operatively connected to said power supply, and a power cord operatively connected to said power supply and extending from said base for connection to a residential power receptacle;

a luminaire comprising a metal halide bulb socket for receiving a metal halide bulb and an enclosure surrounding said socket; and a Joining member connecting said base to said luminaire;

wherein said luminaire further comprises a plurality of bulb sockets for receiving incandescent bulbs.

18. The lamp of claim 17, further including illumination controls to operate said metal halide bulb socket and said incandescent bulb sockets individually or in combination.

19. The lamp of claim 17, further including a dimmer operatively connected to said incandescent bulb sockets for controlling the brightness of an incandescent bulbs installed therein.

20. The lamp of claim 13 wherein one or more of the incandescent bulb sockets is operatively connected to the ballast so that an incandescent bulb received therein provides resistance to the ballast.

21. A portable metal halide table lamp suitable for interior illumination comprising:

a base for supporting the lamp comprising an internal cavity, a power supply mounted within said cavity, a ballast mounted within said cavity operatively connected to said power supply, and a power cord operatively connected to said power supply and extending from said base for connection to a residential power receptacle;

a luminaire comprising a metal halide bulb socket for receiving a metal halide bulb and an enclosure surrounding said socket; and a joining member connecting said base to said luminaire, wherein said joining member further comprises a first quick-connect/disconnect coupling means for joining with said luminaries a second quick-connect/disconnect coupling means for joining with said base, and a passage therebetween.

22. A portable metal halide table lamp suitable for interior illumination comprising:

a base for supporting the lamp comprising an internal cavity, a power supply mounted within said cavity, a ballast mounted within said cavity operatively connected to said power supply, and a power cord operatively connected to said power supply and extending from said base for connection to a residential power receptacle;

a luminaire comprising a metal halide bulb socket for receiving a metal halide bulb and an enclosure surrounding said socket; and a joining member connecting said base to said luminaire, wherein said enclosure surrounding said metal halide bulb socket includes selectively controlled liquid crystal regions for controlling an amount of light passing through said enclosure by varying the opacity of said liquid crystal regions.

23. A portable metal halide lamp comprising:

a base with an internal cavity, a power supply mounted in said base, a ballast mounted in said base and being operatively connected to said power supply;

a luminaire comprising a metal halide bulb socket operatively connected to said ballast and an enclosure surrounding said socket; and means connected to said base for providing mechanical support for said luminaire and electrical connection between said base and said luminaire;

said ballast being a pulse-start, solid-state ballast.

24. The lamp of claim 23, further comprising illumination controls remote from said base.

25. A portable metal halide lamp comprising:

a luminaire;

a metal halide bulb socket mounted within said luminaire;

a base comprising an internal cavity;

an electronics assembly within said cavity for operating the metal halide lamp, said electronics assembly comprising a pulse-start, solid-state ballast; and a joining member connecting said base to said luminaire.

26. The lamp of claim 25 further comprising light transport means for transporting light from said base to said luminaire; wherein said metal halide bulb socket is within said cavity and is operatively connected to said electronics assembly.

27. A combination metal halide and auxiliary bulb lamp comprising a base having an internal cavity, a luminaire separate from said base, said luminaire enclosing a metal halide bulb socket and one or more auxiliary bulb sockets, and an electronics assembly mounted within said base and operatively connected to said metal halide bulb socket.

28. The lamp of claim 27 wherein said auxiliary bulb sockets are incandescent bulb sockets.

29. The lamp of claim 27 wherein said base comprises a housing defining an internal cavity and said electronics assembly is enclosed within said cavity.

30. A portable metal halide lamp comprising:

a base with an internal cavity, a power supply mounted in said base, a ballast mounted in said base and being operatively connected to said power supply;

a luminaire comprising a metal halide bulb socket operatively connected to said ballast; and means connected to said base for providing mechanical support for said luminaire;

wherein said base comprises an access means for accessing the internal cavity, said access means being connected to a safety interlock to isolate electrical power to said lamp when removed from said base.

31. A portable metal halide lamp comprising:

a base with an internal cavity, a power supply mounted in said base;

a ballast mounted in said base and being operatively connected to said power supply;

a luminaire comprising a metal halide bulb socket operatively connected to said ballast; and supporting means for providing mechanical support for said luminaire, said supporting means being connected to said base and said luminaire by quick-connect/disconnect couplings.

32. A portable metal halide lamp comprising:

a base with an internal cavity, a power supply mounted in said base, a ballast mounted in said base and being operatively connected to said power supply;

a luminaire comprising a metal halide bulb socket operatively connected to said ballast and an enclosure surrounding said socket having selectively controlled liquid crystal regions for controlling the amount of light passing through said enclosure by varying the opacity of said liquid crystal regions; and supporting means for providing mechanical support for said luminaire from said base.

33. A portable metal halide lamp comprising:

a metal halide bulb socket;

a base comprising an internal cavity and an access means for accessing said cavity, said access means being connected to a safety interlock to isolate electrical power to said lamp when removed from the base;

an electronics assembly within said cavity for operating the metal halide lamp;

a luminaire; and a joining member connecting said base to said luminaire.

34. A portable metal halide lamp comprising:

a luminaire;

a metal halide bulb socket mounted within said luminaire;

a base comprising an internal cavity;

an electronics assembly within said cavity for operating the metal halide lamp; and a joining member connecting said base to said luminaire by quick-connect/disconnect couplings.

35. A portable metal halide lamp comprising:

a metal halide bulb socket;

a base comprising an internal cavity;

an electronics assembly within said cavity for operating the metal halide lamp;

a luminaire comprising an enclosure having selectively controlled liquid crystal regions for controlling the amount of light passing through said enclosure by varying the opacity of said liquid crystal regions; and a joining member connecting said base to said luminaire.

* * * * *